US005413427A

United States Patent [19]

Giles et al.

[11] Patent Number: 5,413,427

[45] Date of Patent: May 9, 1995

[54] PRINTER ARCHITECTURE STRUCTURE

[75] Inventors: Robert R. Giles, Escondido; Richard M. Kemplin, Poway; Ronald J. Kaplan, San Marcos, all of Calif.

[73] Assignee: Hewlett-Packard Company, Palo Alto, Calif.

[21] Appl. No.: 149,862

[22] Filed: Nov. 9, 1993

[51] Int. Cl.[6] ..... B41J 29/02

[52] U.S. Cl. ..... 400/691; 400/690

[58] Field of Search ..... 400/685, 690, 689, 691, 400/692, 693, 694

[56] References Cited

U.S. PATENT DOCUMENTS

| | | | |
|---|---|---|---|
| 4,726,699 | 2/1988 | Buschmann et al. | 400/690 |
| 4,929,948 | 5/1990 | Holmberg | 400/691 |
| 5,214,574 | 5/1993 | Chang | 400/691 |

FOREIGN PATENT DOCUMENTS

| | | | |
|---|---|---|---|
| 320149 | 6/1989 | European Pat. Off. | 400/691 |
| 3931190 | 3/1991 | Germany | 400/691 |
| 178079 | 9/1985 | Japan | 400/690 |
| 5131718 | 5/1993 | Japan | 400/689 |

OTHER PUBLICATIONS

IBM Tech. Disc. Bulletin vol. 26, No. 1 Jun. 1983 "Frame-Isolation Mount with Balanced Damping ".

IBM Tech. Disc. Bulletin vol. 26 No. 6 Nov. 1983 "Shipping Package for Typewriter".

IBM Tech. Disc. Bulletin vol. 26 No. 3B Aug. 1983 "Compressible Seal".

*Primary Examiner*—Ren Yan

[57] ABSTRACT

A printer architecture structure in which a flexible external case is used to compress and sandwich internal printer structure comprised of a rigid metal base and printer chassis structure by nominally compressing resilient pads between the chassis structure and case top and side walls. Additional resilient pads between the base and chassis structure are ordinarily nominally uncompressed by the flexible case except during application of shock loads during shipment or vibrations during printer operation. The construction minimizes transmission of externally applied shock loads through the internal components of the system and assists in containing vibrations and noise generated during printer operation interiorly of the case. The relatively rigid base comprises a metal enclosure for RF shielding of the electronic components.

13 Claims, 4 Drawing Sheets

PRINTER ARCHITECTURE STRUCTURE

BACKGROUND OF THE INVENTION

The present invention relates to the overall mechanical construction of a computer driven printer and, more specifically, the invention is directed to the printer architecture structure. The term "architecture structure" as used herein, refers to the fundamental mechanical spacial organization of the printer.

It is important to insure that the main structural elements of the printer are designed such that mechanical shock loads which may occur during shipment (such as by dropped packages) and the vibrations which occur during printing are transferred efficiently in the architecture to the mechanical components which will absorb them and, where possible to isolate other printer components, so as to minimize the likelihood of damage to the printer as well as vibrations and noise generated during the printing operation.

Computer driven printers typically comprise a chassis and print media moving means on the chassis for moving print media in various directions extending between the front and the rear of the printer. A printer also has a movable carriage and means for moving it transversely to the direction of paper movement. The carriage is usually mounted on a slider rod/slider bar support system and these elements are mounted on chassis structure which is rigidly affixed to a base inside of the exterior case.

Prior art systems, such as the Hewlett Packard Paint Jet XL300 use a relatively rigid base to the top of which is affixed printer chassis structure which comprises a mounting platform for the movable printer elements. The base, chassis structure and printer elements are all rigidly affixed to each other so as to provide a single rigid structure which is then enclosed within a rigid case which is affixed by screws or snap fasteners to the base and printer structure. Although cushioning pads may be employed internally in the case between the case and the chassis-printer structure, the case itself is intended to perform no significant structural function other than its usual function as a cover and enclosure for the internal components. Thus, shocks to the system which may be caused by dropping or jarring by shipping the container are either absorbed by the case or are transmitted from the case to the rigidly attached chassis structure and base so that all vibrations imparted by the case to the chassis structure are in turn directly imparted to the base and structural shocks imparted to the base are directly transmitted therefrom to the rigidly affixed chassis structure and printer elements.

It is an objective of the invention to provide an improved printer architecture structure in which external shocks applied to the case will be damped and absorbed so that shocks first applied from the case to the chassis structure are substantially isolated from the base and shocks first applied from the case to the base are substantially isolated from the chassis structure and moveable printer elements mounted thereon.

It is a further objective of the invention to minimize external vibration and attendant noise generated during printer operation.

SUMMARY OF THE INVENTION

The present invention accordingly provides a printer architecture structure comprising;

a) a rigid base;

b) printer chassis structure mounted on said base;

c) an exterior case which is relatively flexible compared to said rigid base, said case substantially enclosing said chassis structure and said base, said case resiliently biasing said chassis structure toward said base; and d) resilient pads between said base and said chassis structure and between said chassis structure and said case.

DESCRIPTION OF THE PREFERRED EMBODIMENT

Figure 1:
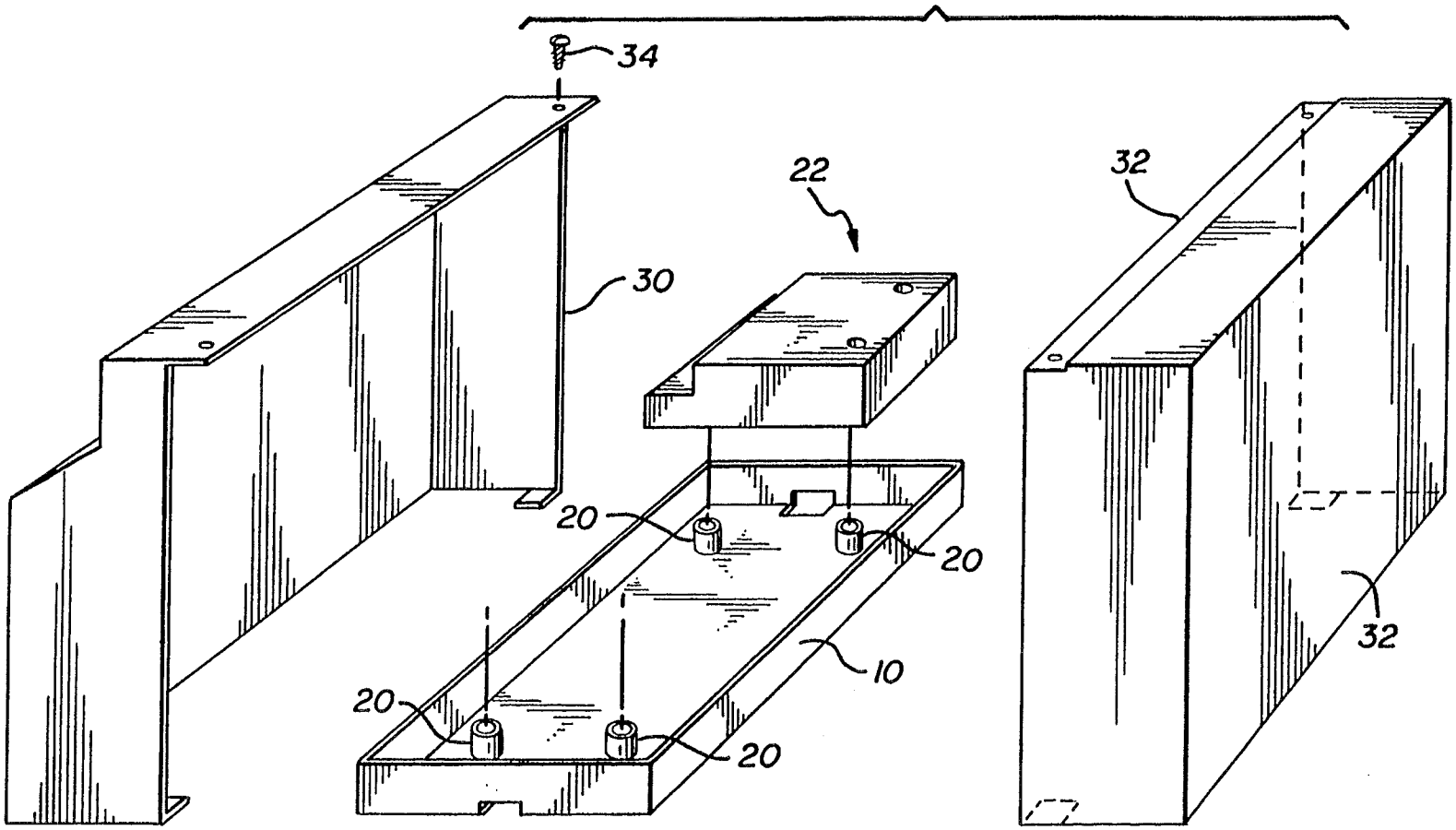
FIG. 1 PRIOR ART
FIG. 1 is an exploded perspective schematic view of a typical prior art printer architecture structure.

As shown in FIG. 1, a typical prior art printer structure has a base 10 in the form of an open and therefore somewhat flexible tray, usually of metal, with a plurality of mounting posts 20 extending upwardly from the bottom of the base. The mounting posts receive printer chassis structure 22 shown schematically which in turn comprises a mounting platform for the remainder of the mechanical parts of the printer. A single part or multipart (as shown) case 30, 32 is then slipped over the printer structure and is affixed by screws 34 directly to the internal chassis structure 22 or to other components enclosed by the case. Cushioning pads may be interposed between the case and the components enclosed thereby.

Figure 2:
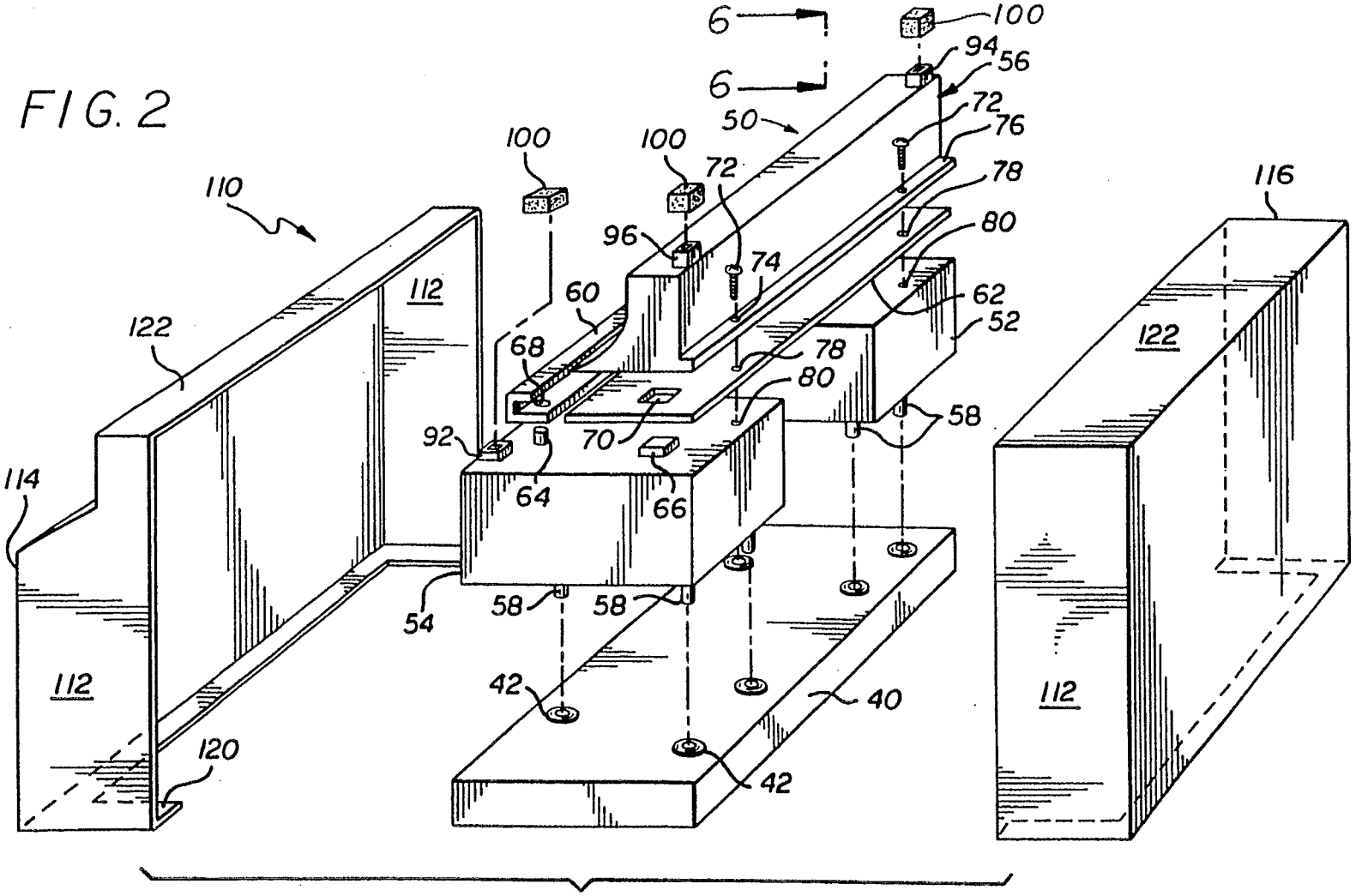
FIG. 2 is an exploded perspective schematic view of a printer architecture structure according to the present invention.
Figure 3:
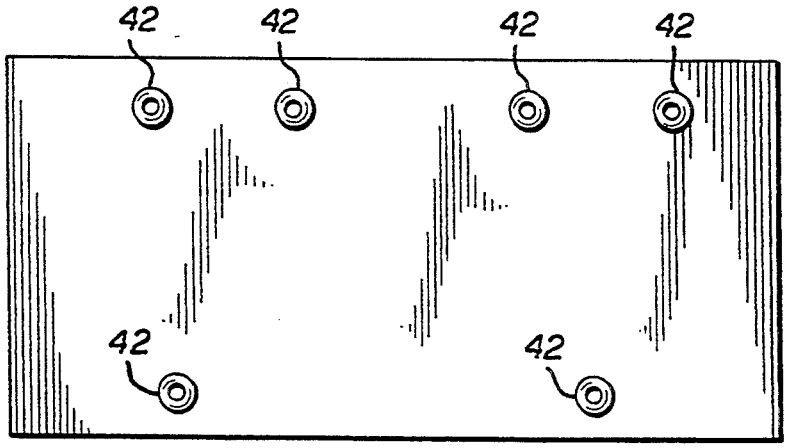
FIG. 3 is a top plan view of an enclosed rigid base used in the present invention.
Figure 4:
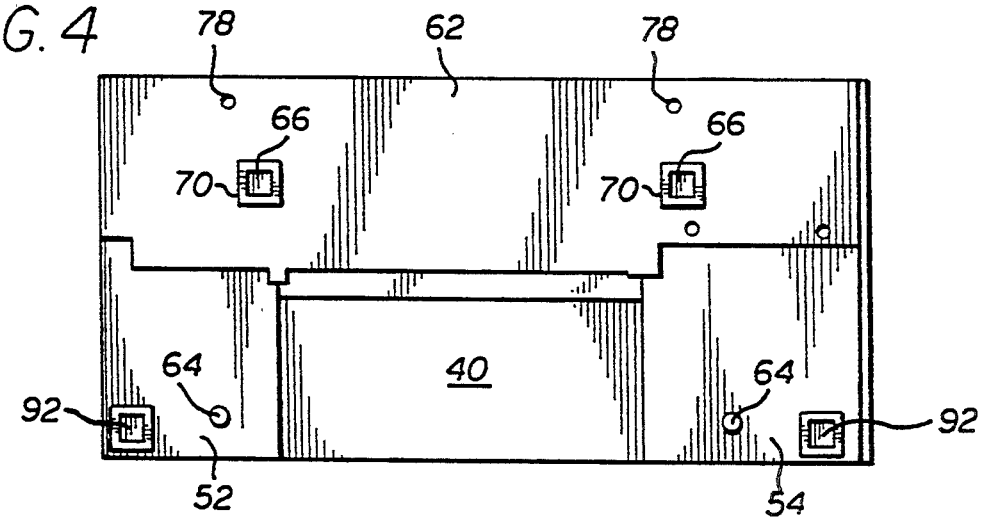
FIG. 4 is a top plan view of the base with left and right chassis members mounted thereon and one of two rigid spacers which maintains precise horizontal spacing between the chassis members.

As shown in FIG. 2, the printer architecture structure of the present invention comprises an enclosed base 40 in the form of a rigid metal box of generally rectangular configuration having a top, bottom and four sides. A plurality of holes extend through the top of the metal base 40 which each receive rubber grommets 42 which each have a portion which extends upwardly above the top of the base 40 to cushion the underside of the printer chassis structure 50 mounted on the base. In its preferred form, the chassis structure 50 is comprised of spaced left and right chassis members 52, 54, usually of molded plastic material, and an elongate plenum member 56 mounted on top of the left and right chassis members 52, 54. A number of mounting posts 58 are preferably integrally molded with the left and right chassis members 52, 54 and extend downwardly therefrom snugly into the grommets 42 for positioning and mounting the chassis structure 50 on the base 40. The posts 58 and grommets 42 are sized so as to provide a comfortable slip fit of the posts 58 into the grommets 42 so that the grommets cushion against both vertical and horizontal movement of the chassis members 52, 54 relative to the enclosed base 40.

Preferably, a rigid spacer or spacers 60, 62 of metal are affixed to the spaced chassis members to maintain precise horizontal spacing therebetween. As shown, the spacers comprise a front slider bar 60 which also serves as a partial support for the transversely movable printer carriage (not shown) and a rear spacer 62 which comprises a flat metal plate. Each spacer 60, 62 is placed onto the spaced left and right chassis members before affixation of the plenum member 56 which is mounted above the rear spacer bar 62. Preferably, integrally molded projections 64, 66 extend upwardly from the spaced chassis members to be received in positioning holes 68, 70 in the spacers 60, 62 and on the bottom of the elongated plenum member 56.

Although not essential, screws 72 (not shown in FIG. 5) may also be used which extend downwardly through holes 74 in a flange or multiple flanges 76 on the plenum member 56 into mating holes 78 in the rear spacer bar and into threaded holes 80 in the spaced chassis members 52, 54 for affixation of the plenum member 56 to the spaced chassis members.

Figure 5:
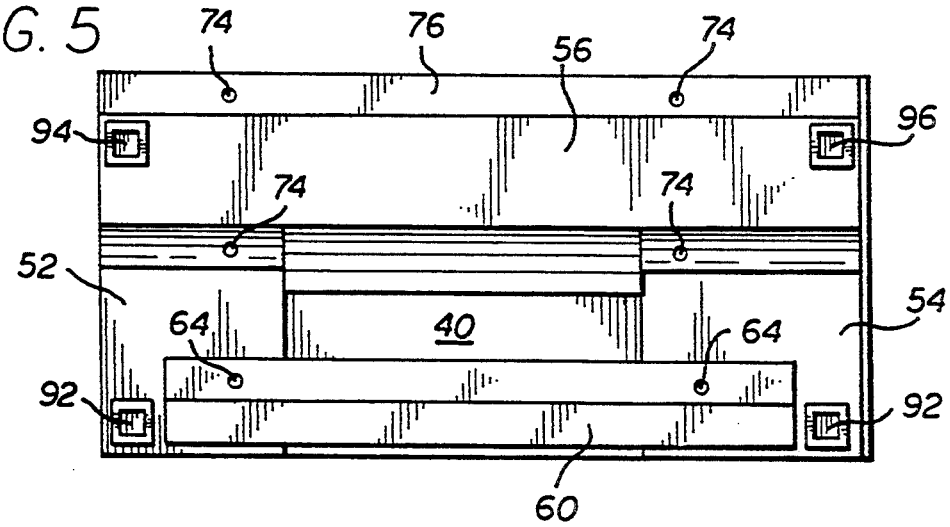
FIG. 5 is a top plan view of the structure of FIG. 4 with a plenum member mounted on the left and right chassis members and a second spacer in the form of a slider bar for supporting a moveable print head.
Figure 6:
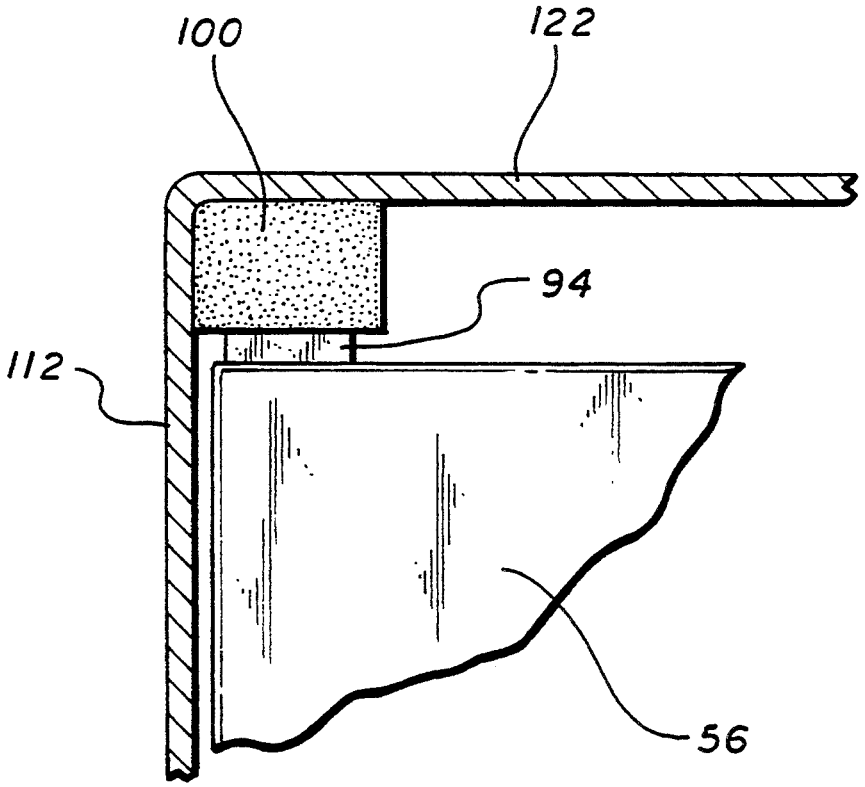
FIG. 6 is an enlarged view of cushioning pads which engage the chassis structure and case.

The chassis structure also has a plurality of upwardly extending columns 90, 92, 94, 96 at the four corners thereof which, as seen best in FIG. 5, comprise two columns 94, 96 which extend upwardly from the plenum member 56 and columns 90, 92 which extend upwardly from each of the spaced left and right chassis members 52, 54 near the front corners thereof. Rectangular elastomeric pads or caps 100 (FIG. 2) are placed onto the tops of each of the upwardly extending columns 90, 92, 94, 96 to provide upwardly facing cushions and vertically facing cushions for engagement with the inner top and interior sidewalls 112 of the case 110 as best seen in FIG. 6.

The case, as best seen in FIG. 2, is a relatively thin wall molded plastic two part structure 114, 116 which is relatively flexible compared to the rigid metal base 40. The case 110 substantially encloses the chassis structure 50 and base 40 in a unique fashion wherein the case 110 biases the chassis structure 50 toward the base 40 thus compressing the pads 100 but without nominally compressing the grommets 42 to sandwich and tightly hold the architecture in its assembled relationship. For this purpose, the case has a peripheral lip 120 at the lower edge thereof which engages the underside of the base 40 and a top wall 122 and side walls 112 which engage the caps 100 on the tops of the upwardly extending columns 90, 92, 94, 96. The front and rear portions 112, 114 of the case 110 abut each other on a vertically extending plane which is located roughly midway between the front and rear sides of the printer.

The present architecture structure facilitates stack up assembly of the printer elements on an automated assembly line in which the base 40, spaced left and right chassis members 52, 54, metal spacers 60, 62, plenum member 56 and other printer elements are respectively stacked up from the bottom during assembly following which the exterior case 110 is manually affixed to the stacked up assembly by using the case to physically compress the internal architecture structural parts toward each other (due to compression of the caps 100 and close tolerance of the internal dimensions of the flexible case 110 relative to the dimensions of the comparatively rigid internal components). Fastening screws (not shown) may also be used if desirable to fasten the two case portions 114, 116 to each other or to provide additional fastening of internal components to each other but such fasteners do not interfere with the efficient absorption of any shocks externally applied to the printer case which, rather than being transmitted to all of the internal parts as in the prior art wherein the chassis structure and base are rigidly affixed to each other and to the case, are quickly absorbed due to the various internal cushions between the case 110 and the chassis structure 50 and between the chassis structure 50 and the base 40. The grommets 42 are not nominally compressed by the case but compress and cushion during application of external shock and vibration. Accordingly, the present architecture reduces the need for stronger internal components allowing a reduction in size, weight and attendant expense.

The use of an enclosed metal base 40 provides not only structural rigidity but also adequate RF shielding for electronic components which are housed in the base.

Persons skilled in the art will readily appreciate that various modifications can be made from the preferred embodiment thus the scope of protection is intended to be defined only by the limitations of the appended claims.

We claim:

1. A printer architecture structure comprising;

a) a rigid base;

b) printer chassis structure mounted on said base;

c) an exterior case which is relatively flexible compared to said rigid base, said case substantially enclosing said chassis structure and said base;

d) resilient grommets between said base and said chassis structure; and e) resilient pads between said chassis structure and said case;

f) a plurality of mounting posts extending between said chassis structure and said base for positioning and mounting said chassis structure on said base, one of said base and said chassis structure having mounting holes therein and the other of said base and said chassis structure including said mounting posts affixed thereto, said grommets being received in said mounting holes and said posts being received in said grommets to cushion movement of said posts in said holes, said case having means thereon engaging said base whereby inherent flexibility of said case compresses said pads and urges said posts into said grommets to affix said chassis structure to said base.

2. The printer architecture structure of claim 1, wherein said grommets are nominally uncompressed except during application of shock or vibration.

3. The printer architecture structure of claim 1, wherein said base is metal.

4. The printer architecture structure of claim 3, wherein said base comprises an RF shielding enclosure.

5. The printer architecture structure of claim 1, wherein said posts extend downwardly from the bottom of said chassis structure and said holes and grommets are in said base.

6. The printer architecture structure of claim 5, wherein said chassis structure is comprised of spaced chassis members and a plenum mounted thereon, said pads between said chassis structure and said case being located on said plenum.

7. The printer architecture structure of claim 6, further comprising rigid spacer bar means affixed to said spaced chassis members to maintain horizontal spacing therebetween.

8. The printer architecture structure of claim 7, wherein said spacer bars and chassis structure have mating positioning apertures and projections extending into said apertures.

9. The printer architecture structure of claim 5, wherein said means on said case which engage said base comprises a peripheral lip which engages the underside of said base, and said case having a top which engages said pads.

10. The printer architecture structure of claim 9, wherein said pads between said chassis structure and said case engage both the top and sides of said chassis structure and case whereby external shocks applied to said case are absorbed by said pads and said chassis structure and whereby vibrations generated during printer operation are substantially contained in said case.

11. The printer architecture of claim 10, further comprising columns which extend upwardly from said chassis structure and wherein said pads between said chassis structure and said case comprise elastomeric caps which extend over the top and sides of said columns.

12. The printer architecture structure of claim 11, wherein said case has front and rear portions which abut each other and some of said caps engage said front portion and some of said caps engage said rear portion of said case.

13. The printer architecture structure of claim 12, wherein each of said case portions has a lower lip which engages the bottom of said base.

* * * * *